US007441549B2

(12) United States Patent
Takayanagi

(10) Patent No.: US 7,441,549 B2
(45) Date of Patent: Oct. 28, 2008

(54) FUEL SUPPLY APPARATUS FOR AND PRESSURE CONTROL METHOD OF INTERNAL COMBUSTION ENGINE

(75) Inventor: Keiichi Takayanagi, Isesaki (JP)

(73) Assignee: Hitachi, Ltd., Tokyo (JP)

( * ) Notice: Subject to any disclaimer, the term of this patent is extended or adjusted under 35 U.S.C. 154(b) by 48 days.

(21) Appl. No.: 11/545,488

(22) Filed: Oct. 11, 2006

(65) Prior Publication Data

US 2007/0084274 A1 Apr. 19, 2007

(30) Foreign Application Priority Data

Oct. 13, 2005 (JP) ..... 2005-299125
Aug. 14, 2006 (JP) ..... 2006-220975

(51) Int. Cl.
*F02M 33/02* (2006.01)

(52) U.S. Cl. ..... 123/520

(58) Field of Classification Search ..... 123/516, 123/518–520, 198 D
See application file for complete search history.

(56) References Cited

U.S. PATENT DOCUMENTS 5,054,454 A * 10/1991 Hamburg ..... 123/520
5,146,902 A * 9/1992 Cook et al. ..... 123/518
5,297,529 A * 3/1994 Cook et al. ..... 123/520
5,383,437 A * 1/1995 Cook et al. ..... 123/520
5,425,344 A * 6/1995 Otsuka et al. ..... 123/520
5,765,538 A * 6/1998 Krimmer et al. ..... 123/516
5,992,395 A * 11/1999 Hartsell et al. ..... 123/516
6,131,550 A * 10/2000 Fritz et al. ..... 123/520
6,250,288 B1 * 6/2001 Fritz ..... 123/520
6,301,955 B1 * 10/2001 Cook et al. ..... 73/49.7
6,321,728 B1 * 11/2001 Ohkuma ..... 123/520
6,561,009 B1 * 5/2003 Perry et al. ..... 73/49.7
6,622,545 B2 * 9/2003 Weldon et al. ..... 73/49.7
6,695,895 B2 * 2/2004 Hyodo et al. ..... 96/111
6,722,348 B2 * 4/2004 Nagasaki et al. ..... 123/520
6,834,535 B2 * 12/2004 Kano et al. ..... 73/49.7
6,913,002 B2 * 7/2005 Mashimo et al. ..... 123/520
6,971,375 B2 * 12/2005 Amano et al. ..... 123/520
6,993,957 B2 * 2/2006 Kano et al. ..... 73/49.7
7,036,354 B2 * 5/2006 Itakura et al. ..... 73/40
7,036,359 B2 * 5/2006 Hayakawa et al. ..... 73/118.1
7,051,718 B2 * 5/2006 Tsuruta et al. ..... 123/519
7,096,858 B2 * 8/2006 Ohhashi et al. ..... 123/516
7,121,137 B2 * 10/2006 Hosoya ..... 73/118.1
7,124,749 B2 * 10/2006 Ohhashi et al. ..... 123/520
7,216,637 B2 * 5/2007 Uchida et al. ..... 123/520

(Continued)

FOREIGN PATENT DOCUMENTS

JP 05-180098 A 7/1993

(Continued)

*Primary Examiner*—Thomas N Moulis
(74) *Attorney, Agent, or Firm*—Foley & Lardner LLP

(57) ABSTRACT

A leak diagnosing technology in which a diagnostic space capable of being closed is defined which includes therein a fuel tank and a canister, the closed diagnostic space being pressurized by an air pump to diagnose of presence or absence of a leak in the diagnostic space based on whether or not a pressure in the diagnostic space indicates a predetermined pressure change. When the diagnosis is completed, the air pump is reversely rotated to cause a reduction in the pressure in the diagnostic space to thereby quickly return the pressure to a target pressure in a steady state.

19 Claims, 10 Drawing Sheets

U.S. PATENT DOCUMENTS

| | | | | |
|---|---|---|---|---|
| 7,228,851 | B2 * | 6/2007 | Nakamura et al. | 123/519 |
| 7,246,608 | B2 * | 7/2007 | Kano et al. | 123/519 |
| 7,363,803 | B2 * | 4/2008 | Hayakawa et al. | 123/516 |
| 2003/0226549 | A1 * | 12/2003 | Takagi et al. | 123/520 |
| 2005/0011185 | A1 * | 1/2005 | Annoura et al. | 60/289 |
| 2005/0022588 | A1 * | 2/2005 | Hayakawa et al. | 73/118.1 |
| 2006/0016253 | A1 * | 1/2006 | Kobayashi et al. | 73/118.1 |
| 2006/0225714 | A1 * | 10/2006 | Kano et al. | 123/520 |
| 2006/0283427 | A1 * | 12/2006 | Koyama et al. | 123/519 |
| 2007/0157908 | A1 * | 7/2007 | Kano et al. | 123/520 |

FOREIGN PATENT DOCUMENTS

| | | | |
|---|---|---|---|
| JP | 05-272417 | A | 10/1993 |
| JP | 2004-162685 | A | 6/2004 |

* cited by examiner

FUEL SUPPLY APPARATUS FOR AND PRESSURE CONTROL METHOD OF INTERNAL COMBUSTION ENGINE

BACKGROUND OF THE INVENTION

1. Field of the Invention

The present invention relates to a fuel supply apparatus for and a pressure control method of an internal combustion engine, and particularly relates to a technique of controlling pressure in a fuel tank.

2. Description of the Related Art

Japanese Unexamined Patent Publication No. 05-272417 discloses an apparatus for determining that a hole or leak has occurred when an inside of the fuel tank is pressurized by a pump and a pressure in the fuel tank cannot be increased to a predetermined pressure.

Japanese Unexamined Patent Publication No. 05-180098 also discloses an apparatus for diagnosing whether a leak is present or absent based on a reduction in a fuel-tank internal pressure in response to an intake negative pressure of an internal combustion engine which negative pressure is introduced into a fuel tank to prevail thereinside.

Furthermore, Japanese Unexamined Patent Publication No. 2004-162685 discloses an apparatus including a pump for drawing out air in a treatment path of a fuel vapor, through a canister and for diagnosing whether a leak of fuel vapor is present or absent based on a reduction in pressure in the treatment path of fuel vapor when the pressure is reduced by the pump.

However, even if execution of pressurization or pressure reduction is stopped to open the fuel tank to the atmosphere through the canister when the leak diagnosis is completed, it may take a long time for an internal pressure of the fuel tank to become a pressure in a steady state (i.e., at around the atmospheric pressure) in some cases, depending on a tank shape or a condition of the canister.

When the leak diagnosis is carried out by pressurizing the inside of the fuel tank, if the internal pressure of the fuel tank is kept high even after the diagnosis is completed, and if there is a leak, a leakage of the fuel vapor from the leak becomes large.

When the leak diagnosis is carried out by reducing the pressure inside the fuel tank, since the fuel is likely to be vaporized when the pressure in the fuel tank is low, if the pressure-reduced state continues for a long time after the diagnosis is completed, a large quantity of fuel vapor may be generated. The large quantity of fuel vapor generation will enrich an air-fuel ratio of the engine. Moreover, if a large quantity of fuel vapor is generated, the fuel vapor may be easily permitted to leak or flow toward the outside of a vehicle.

SUMMARY OF THE INVENTION

Therefore, taking into consideration the above problems, an object of the present invention is to provide a fuel supply apparatus for an internal combustion engine and a pressure control method of an internal combustion engine by which a pressure in a fuel tank is converged on a target pressure in a steady state, with high responsibility.

To achieve the above object according to the present invention, a detection value of the pressure inside the fuel tank and that of the target pressure in the steady state are compared with each other to control a pump for changing the pressure inside the fuel tank.

The above and other objects, features and advantages of this invention will become understood from the following description with reference to the accompanying drawings.

DESCRIPTION OF THE PREFERRED EMBODIMENTS

Figure 1:
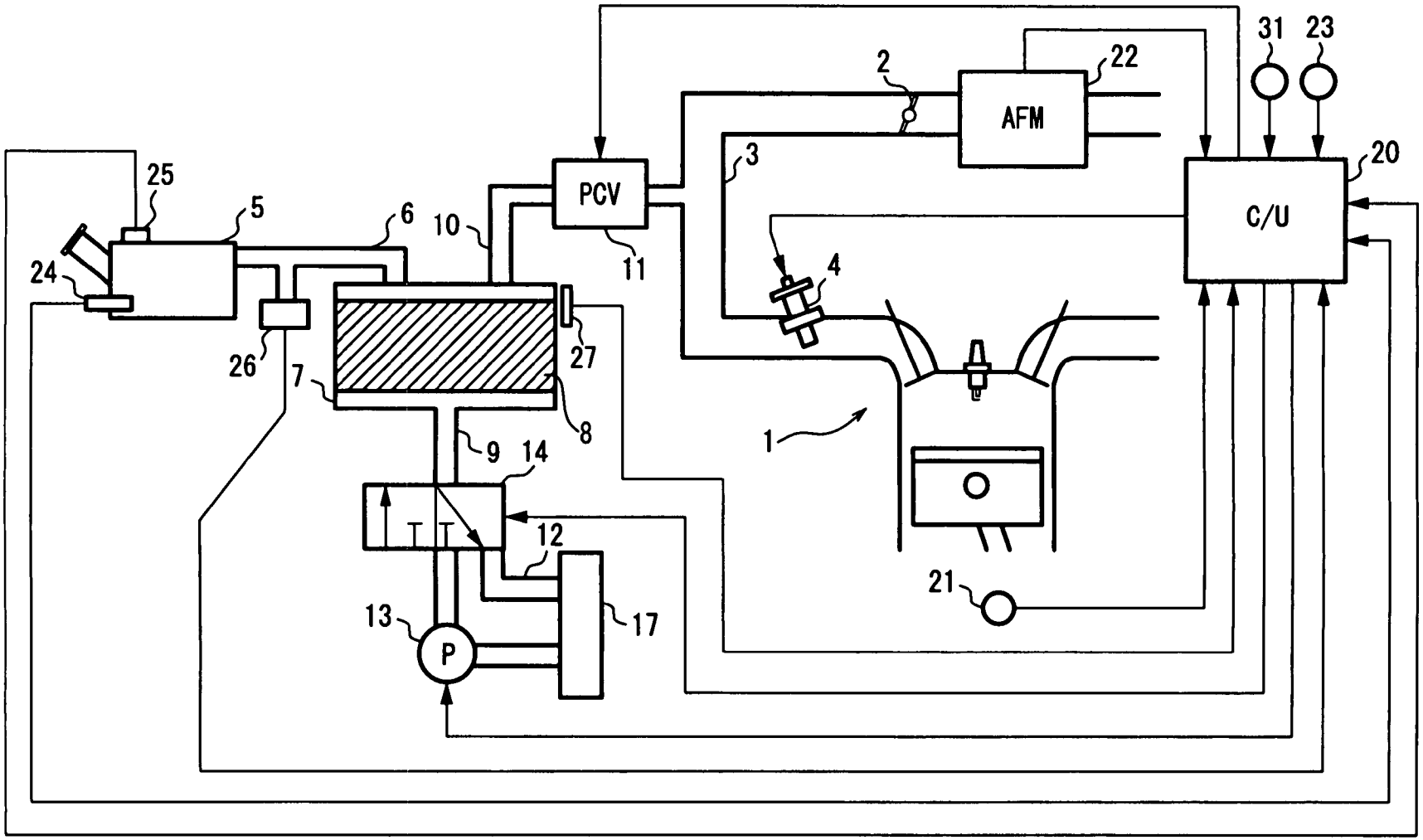
FIG. 1 is a drawing showing an internal combustion engine to which the present invention is applied.

FIG. 1 is a system chart of an internal combustion engine for a vehicle.

In FIG. 1, a throttle valve 2 is provided in an intake passage 3 of an internal combustion engine 1. An intake air amount of engine 1 is regulated by an opening degree of throttle valve 2. In intake passage 3 on a downstream side of throttle valve 2, an electromagnetic fuel injection valve 4 is provided for each cylinder. Fuel injection valve 4 opens in response to a driving signal outputted from a control unit 20. Fuel stored in a fuel tank 5 is force-fed to fuel injection valve 4 by a fuel pump (not shown in the figure). A fuel vapor generated in fuel tank 5 is adsorbed and collected by a canister 7 through a fuel vapor passage 6. Canister 7 is a container in which an adsorbent 8 such as activated carbon is filled. Afresh air introducing port 9 is formed in canister 7 and a purge passage 10 is led out from canister 7.

Purge passage 10 is connected to intake passage 3 on a downstream side of throttle valve 2 via a purge control valve 11. An opening degree of purge control valve 11 is regulated by a signal outputted from control unit 20. Control unit 20 performs a control to open purge control valve 11 when a purge permission condition is satisfied. When purge control valve 11 is opened, the intake negative pressure of engine 1 acts on canister 7 and as a result, the fuel vapor that has been adsorbed by canister 7 is desorbed by a fresh air introduced from fresh air introducing port 9. The purge gas including the desorbed fuel vapor is drawn into intake passage 3 through purge passage 10 and is supplied to engine 1 together with the fuel injected by fuel injection valve 4.

A fuel vapor treatment system is configured by the above-mentioned elements and parts, i.e., by fuel tank 5, fuel vapor passage 6, canister 7, purge passage 10, and purge control valve 11.

Here, in order to diagnose the occurrence of fuel vapor leak in the fuel vapor treatment system, an electric air pump 13 is connected to fresh air introducing port 9 of canister 7 via an electromagnetic switching valve 14.

Switching valve 14 connects either one of an atmospheric opening port 12 and air pump 13 to fresh air introducing port 9, and is normally kept in a state where atmospheric opening port 12 is connected to fresh air introducing port 9.

Both atmospheric opening port 12 and air pump 13 introduce a clean air filtered by an air cleaner 17 into canister 7 through fresh air introducing port 9. Air pump 13 is an electric pump in which a pump section rotationally driven by a brushless motor and which switches a direction of rotation between normal and reverse by changing a direction of application of voltage to the brushless motor.

During the normal rotation of air pump 13, air is supplied to canister 7 to pressurize inside fuel tank 5. During the reverse rotation of air pump 13, air is drawn from canister 7 to reduce pressure inside fuel tank 5. It should be noted that air pump 13 may be constituted by such a pump in which a rotating direction of the pump section of the pump is fixed and an intake port and a discharge port thereof are changed from one another by switching to thereby switch between supplying of air and drawing of air.

Control unit 20 includes a microcomputer formed while including a CPU, ROM, RAM, an A/D converter, an input/output interface, and the like, and signals are inputted to control unit 20 from various sensors.

As the various sensors, there are provided a crank angle sensor 21 for outputting a crank angle signal in synchronization with the rotation of engine 1, an air flow meter 22 for measuring a flow rate of intake air, a vehicle speed sensor 23 for detecting a traveling speed of the vehicle on which engine 1 is mounted, a fuel temperature sensor 24 for detecting a fuel temperature in fuel tank 5, a fuel level sensor 25 for detecting a remaining amount of fuel in fuel tank 5, a pressure sensor 26 for detecting pressure in fuel vapor passage 6, and the like.

Here, control unit 20 has functions of controlling fuel injection valve 4 and purge control valve 11 according to a program stored in advance, and diagnosing whether any leak is present or absent in the fuel vapor treatment system.

Figure 2:
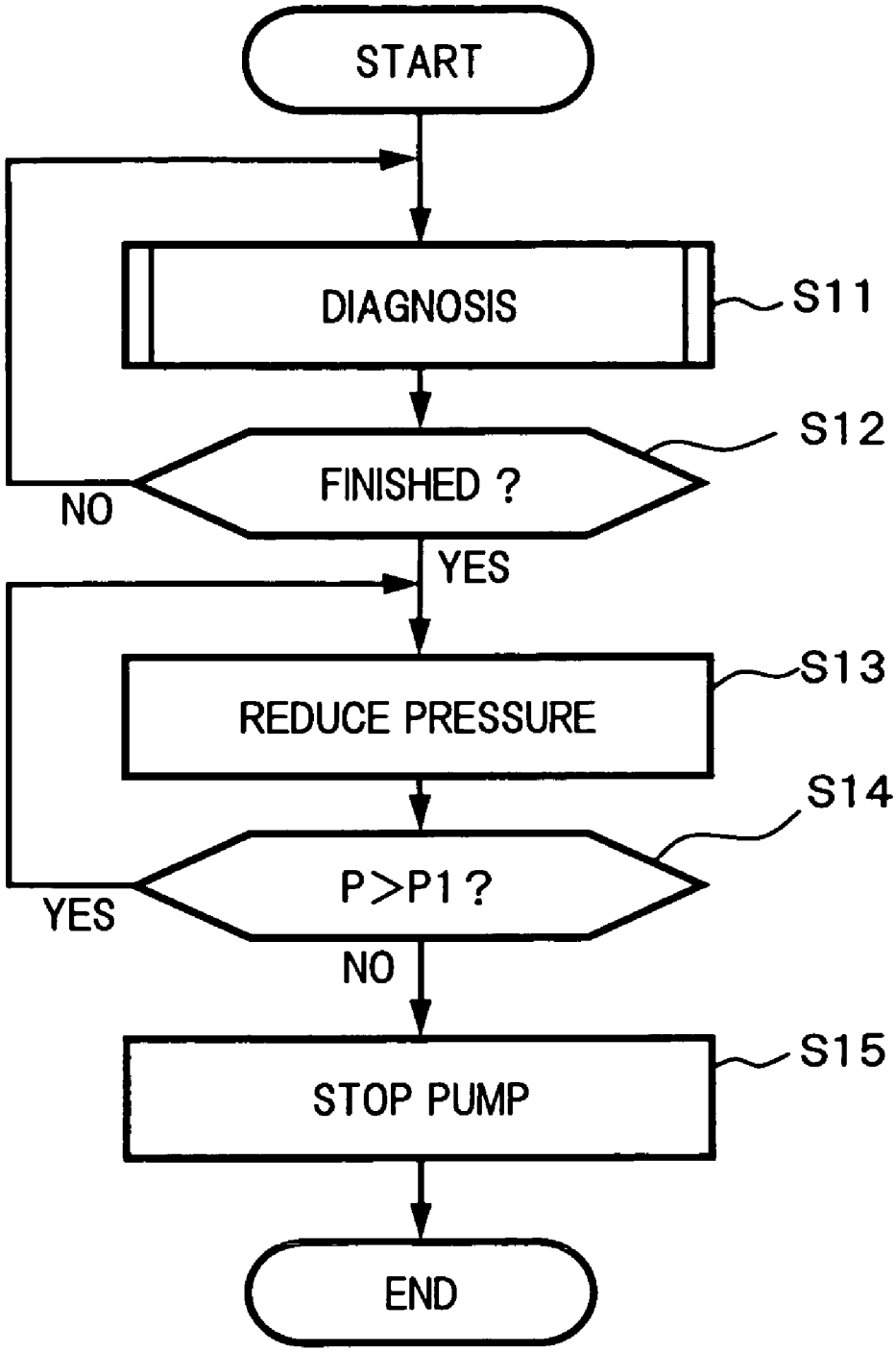
FIG. 2 is a flow chart showing a first embodiment of the present invention.

A flow chart of FIG. 2 shows a main routine of a tank internal pressure control including the leak diagnosis.

First, at step S11, the leak diagnosis is carried out. Details of the leak diagnosis will be described specifically according to a flow chart of FIG. 3.

Figure 3:
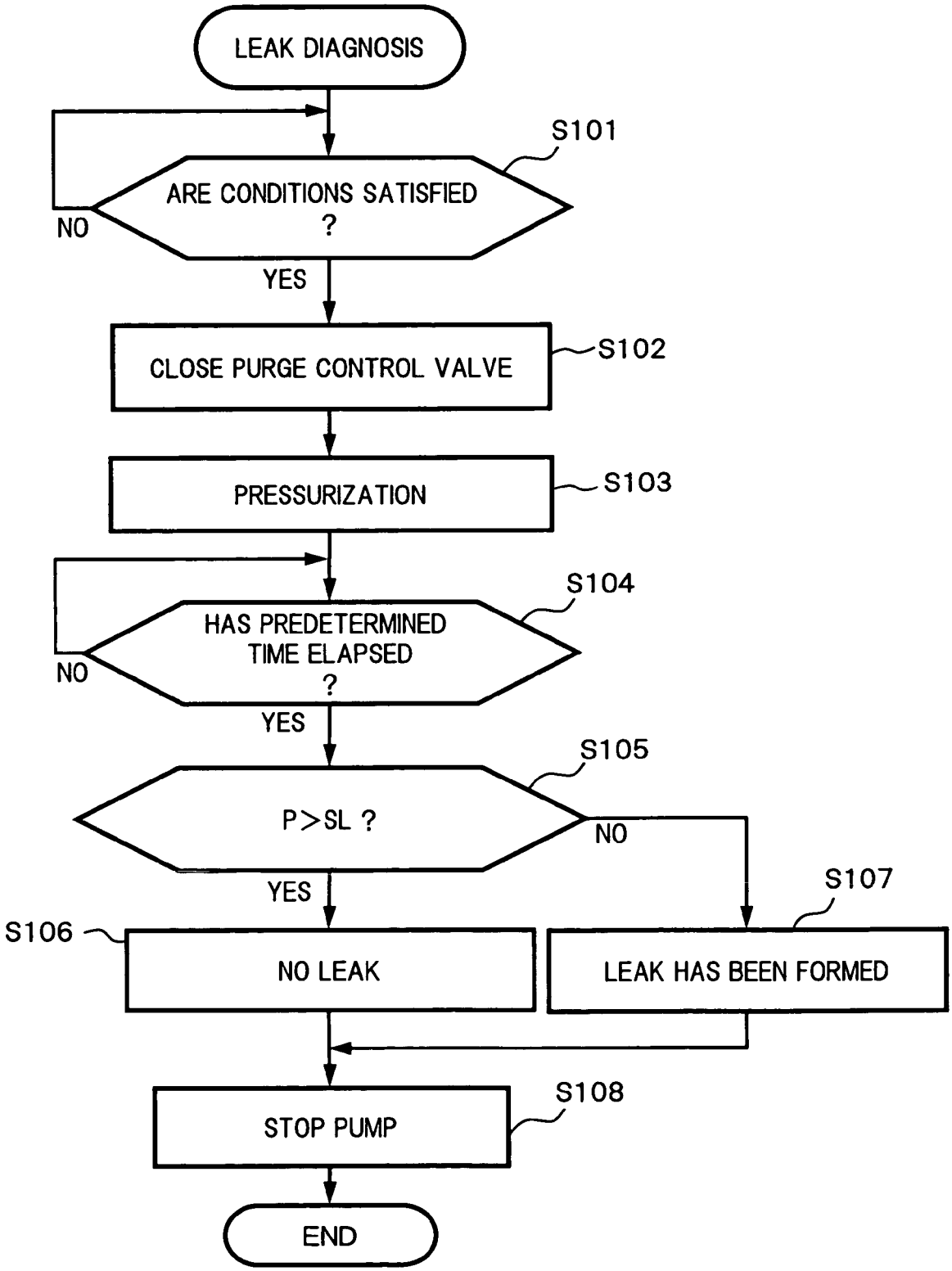
FIG. 3 is a flow chart showing a leak diagnosis according to the first embodiment.

In the flow chart of FIG. 3, at step S101, whether or not conditions for performing the leak diagnosis are satisfied is determined.

More concretely, it is determined that the conditions for performing the leak diagnosis are satisfied when it is after turning off of a key switch, the fuel temperature is equal to or lower than a predetermined temperature, and the remaining amount of fuel in fuel tank 5 is within a predetermined range.

If the conditions for performing the leak diagnosis are satisfied, the control proceeds to step S102.

At step S102, purge control valve 11 is held close while switching valve 14 is switched so that air pump 13 is connected to fresh air introducing port 9. Thus, fuel tank 5, fuel vapor passage 6, canister 7, and purge passage 10 on the upstream side of purge control valve 11 define a closed diagnostic space.

At next step S103, air pump 13 is rotated normally, so that air that has passed through air cleaner 17 is fed into canister 7 to thereby pressurize the diagnostic space.

At step S104, whether or not a predetermined time has passed since the pressurization started is determined. After the pressurization continues for the predetermined time, the control proceeds to step S105 where a pressure P detected by pressure sensor 26 and a threshold value SL are compared with each other. Here, if the pressure P detected by pressure sensor 26 is equal to or lower than the threshold value SL, it is estimated that there is any pinhole-like leak or leaks in a wall face or connections defining the above-mentioned diagnostic space and the control proceeds to step S107 to determine that the leak has been formed.

On the other hand, if the pressure P detected by pressure sensor 26 exceeds the threshold value SL, it is estimated that the pressure has been increased to the predetermined value because there is no leak in the wall face or the connection forming the diagnostic space, and the control proceeds to step S106 to determine that there is no leak.

At step S108, air pump 13 is stopped and switching valve 14 is switched to a state in which atmospheric opening port 12 is connected to fresh air introducing port 9.

It should, however, be noted that the conditions for performing the leak diagnosis and the method of diagnosing leak are not limited to those described above. For example, it is possible to determine a pressure prevailing in the diagnostic space according to a change in a load applied to air pump 13, to determine the condition of the diagnosis by employing the vehicle speed, an engine rotational speed, an inclination of the vehicle, and the like, or to diagnose whether or not any leak is present according to a pressure rising speed.

The leak diagnosis is conducted at step S11 as described above and whether or not the leak diagnosis has been completed is determined at the next step S12.

If the diagnosis has been finished, the control proceeds to step S13.

At step S13, switching valve 14 is switched to a state in which air pump 13 is connected to fresh air introducing port 9, and then air pump 13 is driven to rotate in a direction reverse to that in the operation of diagnosis.

If air pump 13 is in a reverse rotation, the air in the diagnostic space is forcibly drawn out through canister 7 to quickly reduce the pressure in the diagnostic space which has been increased due to pressurization for the diagnosis.

At step S14, whether or not the pressure P detected by pressure sensor 26 has reduced to a pressure equal to or lower than a set value P1 is determined. Until the pressure P reduces to the value equal to or lower than the set value P1, the control returns to step S13 to continue drawing of the air by driving air pump 13 to rotate in the reverse direction.

The set value P1 is a target pressure in the steady state and is set to a value slightly higher than atmospheric pressure.

When it is determined that the pressure P has reduced to the value equal to or lower than the set value P1 at step S14, the control proceeds to step S15 where air pump 13 is stopped and switching valve 14 is switched to the state in which atmospheric opening port 12 is connected to fresh air introducing port 9.

As described above, if the air is drawn from the diagnostic space by air pump 13 immediately after the pressurization for the diagnosis, it is possible to quickly reduce the tank internal pressure. Moreover, because air pump 13 that has been used in the operation of leak diagnosis is reversed in the rotating direction thereof, it is possible to achieve quick reduction in pressure with a simple system.

Furthermore, because drawing of the air by the suction of air pump 13 is carried out through canister 7, the fuel vapor included in the diagnostic space is adsorbed and collected by canister 7 to thereby prevent the fuel vapor from flowing or leaking into the atmosphere together with the drawn air.

For example, in case where there is any leak, if the pressure that has been increased to execute the diagnosis is stagnant to quickly reduce, there might be a possibility such that a large amount of leakage of fuel vapor occurs through the leak. In this case, by quickly reducing the pressure, it is possible to suppress occurrence of leakage of the fuel vapor through the leak. Moreover, because the pressure is reduced by drawing out of the air through canister 7, it is possible to cause canister 7 to actively adsorb and collect the fuel vapor existing in the diagnostic space.

Here, it is possible to employ a configuration in which the pressure is reduced by driving air pump 13 to rotate in reversed direction, only when it is diagnosed that there is a leak or leaks according to the leak diagnosis. Furthermore, if it is diagnosed that the leak is present, it is possible to set the target value of pressure on the pressure reduction to a lower pressure value than that in the case where there is no leak.

However, if canister 7 is saturated, the fuel vapor merely passes through canister 7, so that the pressure reduction performed by driving air pump 13 may increase the leakage of the fuel vapor into the atmosphere instead of decrease.

Figure 4:
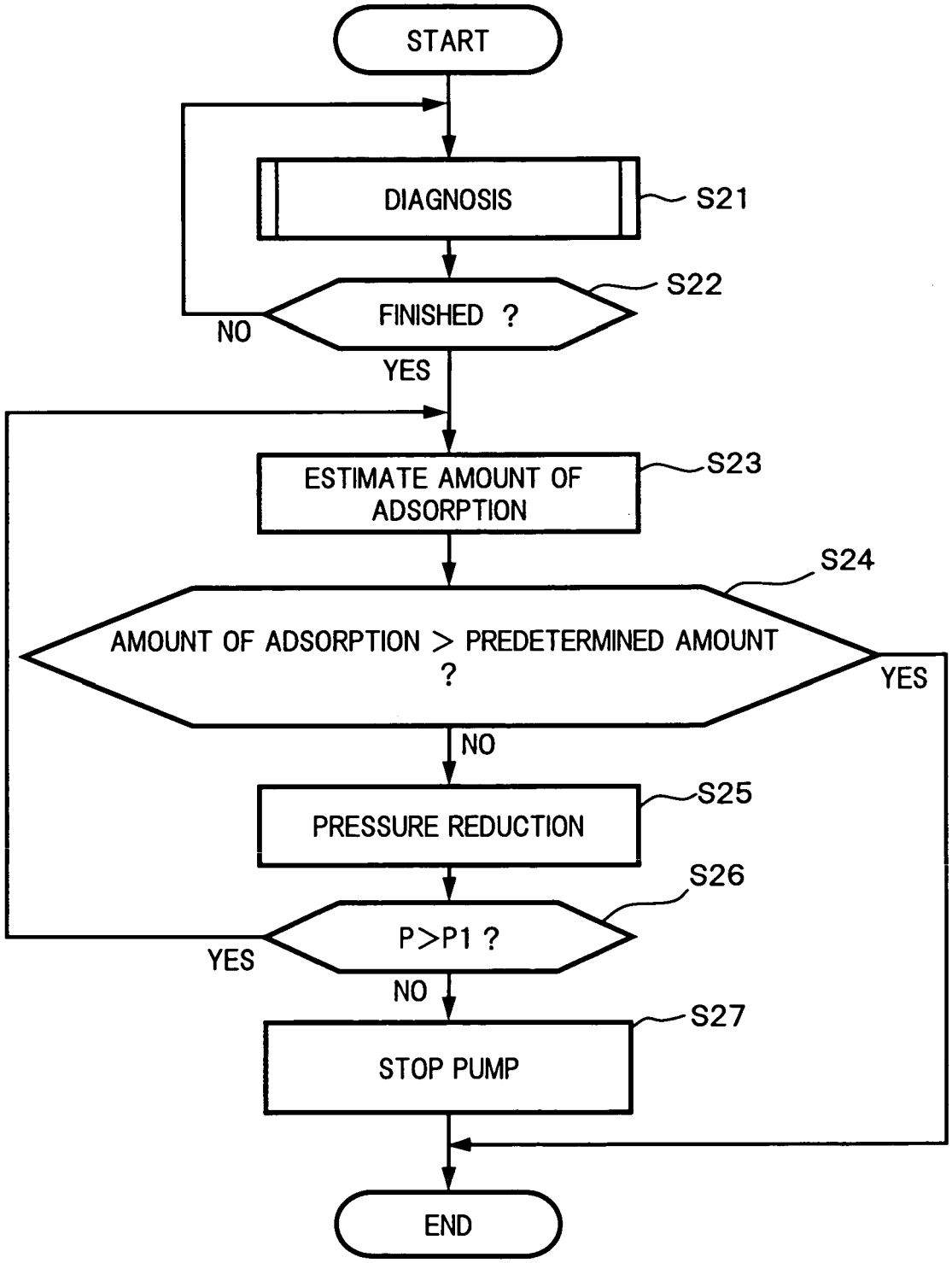
FIG. 4 is a flow chart showing a second embodiment of the present invention.

Therefore, as shown in a flow chart of FIG. 4, it is possible to prohibit the pressure-reducing processing that reversely rotates air pump 13 based on an amount of adsorbed fuel vapor to the canister 7.

In the flow chart of FIG. 4, the control proceeds to step S23, when the leak diagnosis is carried out at step S21, and when it is determined that the leak diagnosis has completed at step S22.

At step S23, the amount of adsorbed fuel vapor in canister 7 is estimated.

As a method of estimating the amount of adsorbed fuel vapor, various known methods may be used.

Specifically, a method of estimating an amount of adsorbed fuel vapor from a time integration value of a difference between temperatures at a peripheral portion and inside the canister as disclosed in Japanese Unexamined Patent Publication No. 06-093932, a method of estimating an amount of adsorbed fuel vapor based on an electric energy supplied to a heater embedded in a canister and based on an average temperature in the canister as disclosed in Japanese Unexamined Patent Publication No. 06-147035, a method of estimating an amount of adsorbed fuel vapor from a fuel concentration in purged air from a canister as disclosed in Japanese Unexamined Patent Publication No. 2004-162685, and the like can be employed.

In the present embodiment, by using a displacement sensor 27 for detecting a displacement of the adsorbent of canister 7 due to cubical expansion, the amount of adsorbed fuel vapor in canister 7 is estimated.

At the next step S24, whether or not the amount of adsorbed fuel vapor in canister 7 estimated at step S23 is greater than a predetermined amount is determined.

If the amount of adsorbed fuel vapor exceeds the predetermined amount, an amount of fuel vapor which is to be adsorbed by canister 7 can be small. In this case, if air pump 13 is rotated reversely to draw out the air from the diagnostic space, there is a possibility that the fuel vapor included in the diagnostic space does not adsorb to canister 7 and is discharged as it is into the atmosphere.

Therefore, if it is determined that the amount of adsorbed fuel vapor in canister 7 exceeds the predetermined amount at step S24, steps 25 through 27 are bypassed so as to finish the present routine to thereby prohibit the pressure-reducing processing executed by driving air pump 13 to rotate in reverse direction.

On the other hand, if it is determined that the amount of adsorbing of fuel vapor to canister 7 is equal to or smaller than the predetermined amount, the control proceeds to step S25 where switching valve 14 is switched to the state in which air pump 13 is connected to fresh air introducing port 9 and air pump 13 is driven in the direction reverse to that in the diagnosis.

If air pump 13 is reversely rotated, the air in the diagnostic space is forcibly drawn through canister 7 to quickly reduce the pressure prevailing in the diagnostic space which has been increased due to pressurization for the diagnosis.

Moreover, because the pressure reducing processing is carried out after confirming that the amount of adsorbing of fuel vapor to canister 7 is sufficiently small, it is possible to avoid undesired discharge of the fuel vapor into the atmosphere as the air is drawn by the suction of air pump 13.

At step S26, determination as to whether or not the pressure P detected by the pressure sensor 26 has reduced to a pressure equal to or lower than the set value P1 is executed while continuously drawing the air by the suction of air pump 13 driven in the reverse rotation until the pressure P reduces to the value equal to or lower than the set value P1.

Then, if it is determined that the tank internal pressure P has reduced to the value equal to or lower than the set value P1, the control proceeds to step S27 where air pump 13 is stopped and switching valve 14 is switched to the state in which atmospheric opening port 12 is connected to the fresh air introducing port 9.

It is possible to reduce the pressure in the diagnostic space and to perform a diagnosis of presence or absence of the leak based on whether or not the pressure has reduced to the predetermined pressure as a result of the pressure reduction. Then, after the leak diagnosis by the pressure reduction, the diagnostic space can be pressurized by air pump 13 to increase the pressure to the target pressure in the steady state.

Figure 5:
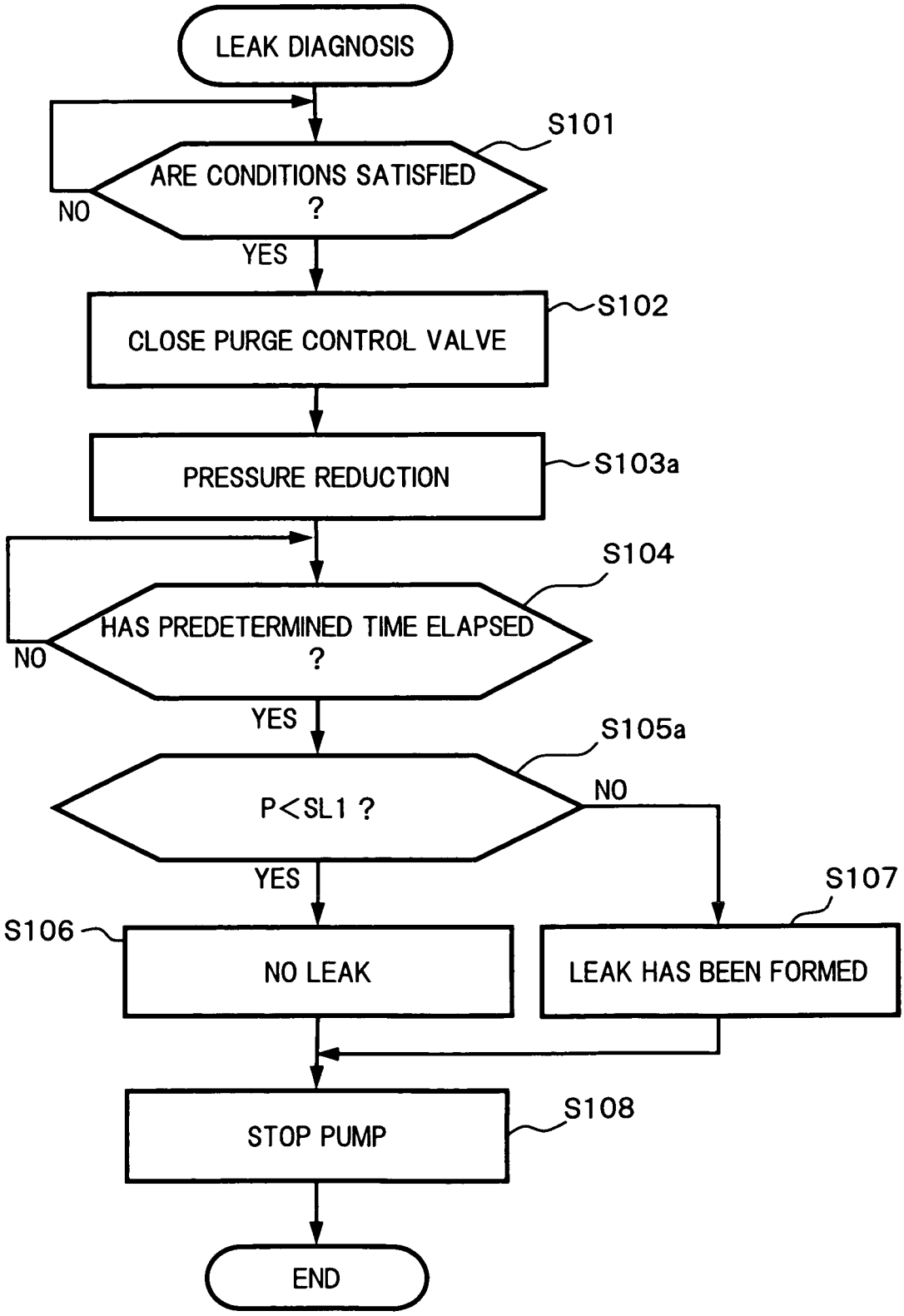
FIG. 5 is a flow chart showing a leak diagnosis according to a third embodiment of the present invention.

If the leak diagnosis is carried out by pressure reduction as described above, when the diagnosis conditions are satisfied, air pump 13 is driven for reverse rotation to reduce pressure in the diagnostic space at step S103*a* as shown in FIG. 5. As a result of this pressure reduction, if the pressure P reduces to a value smaller than a threshold value SL1, it is determined that there is no leak (step S105*a*).

Figure 6:
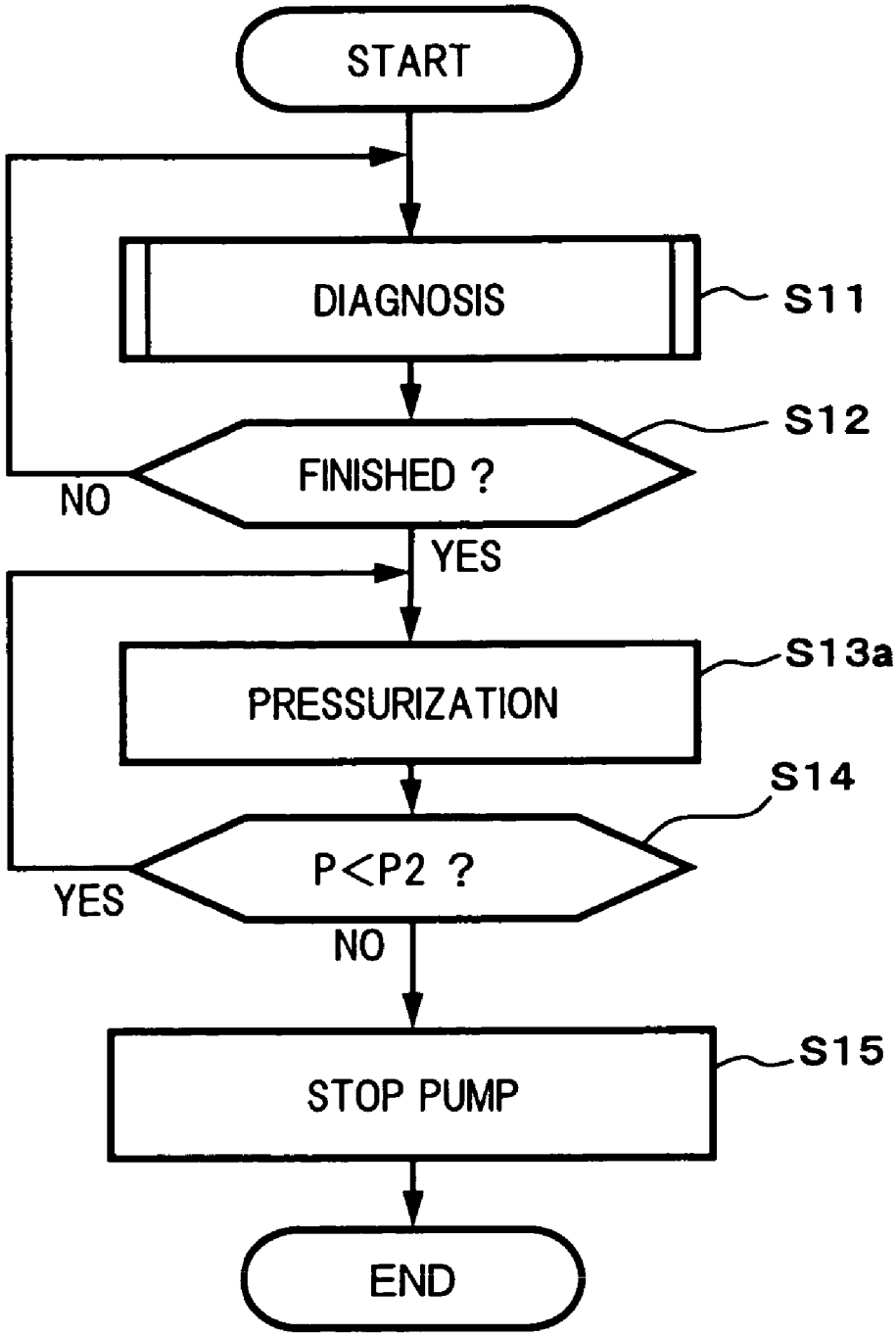
FIG. 6 is a flow chart showing the third embodiment of the present invention.

Then, after the leak diagnosis is completed, as shown in FIG. 6, air pump 13 is rotated normally to pressurize the diagnostic space at step S13*a* and the pressurization is continued as long as the pressure P is lower than the set value P2 (S14*a*→S13*a*).

In carrying out the leak diagnosis by pressure reduction, if purge control valve 11 is opened while closing fresh air introducing port 9 during operation of engine 1, the intake negative pressure of engine 1 acts on fuel tank 5, canister 7, and the like to reduce the pressure in the diagnostic space. After the diagnosis by using such intake negative pressure, air pump 13 is rotated normally to pressurize the diagnostic space to thereby quickly increase the pressure to the afore-mentioned target pressure in the steady state.

It is not only when the pressurization is carried out by air pump 13 for the diagnosis as described above that the tank internal pressure becomes considerably higher than the target pressure in the steady state. For example, the internal pressure may become high when a sudden increase in a temperature, e.g., the ambient temperature, occurs in some cases.

Figure 7:
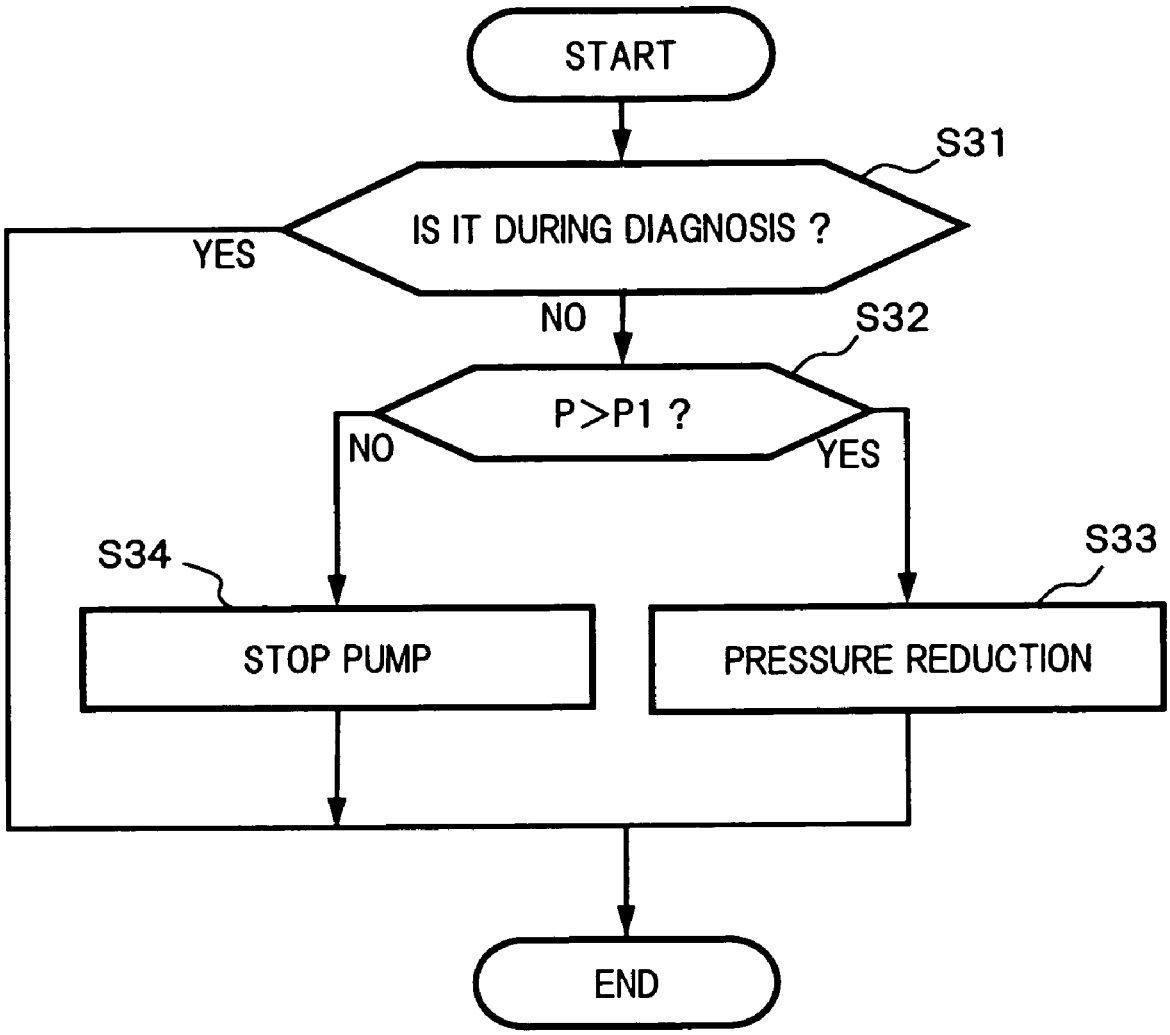
FIG. 7 is a flow chart showing a fourth embodiment of the present invention.

Therefore, in an embodiment shown in a flow chart in FIG. 7, air pump 13 is rotated reversely not only immediately after the diagnosis accompanied with pressurization but also when the tank internal pressure increases over the target pressure in the steady state to thereby avoid increase in the tank internal pressure.

More specifically, in the flow chart in FIG. 7, at step S31, it is determined whether or not the operation of the leak diagnosis is under execution.

If the leak diagnosis is under execution, the present routine is finished as it is.

If the leak diagnosis is not under execution, on the other hand, the control proceeds to step S32 where whether or not the pressure P detected by pressure sensor 26 is higher than the set value P1 is determined. The set value P1 is a target pressure in the steady state and set to a value slightly higher than atmospheric pressure.

Here, if it is determined that the tank internal pressure P is higher than the set value P1, the control proceeds to step S33 where switching valve 14 is switched to the state in which air pump 13 is connected to fresh air introducing port 9 to drive air pump 13 for reverse rotation.

By driving air pump 13 for reverse rotation, the air in the space in the tank is drawn to quickly reduce the tank internal pressure P toward the set value P1.

If the tank internal pressure P has reduced to the set value P1 by driving air pump 13 for reverse rotation, the control proceeds from step S32 to S34 where air pump 13 is stopped and switching valve 14 is switched to a state in which atmospheric opening port 12 is connected to fresh air introducing port 9.

With the above configuration, even if the tank internal pressure tends to increase under a high-temperature condition, the tank internal pressure can be caused to quickly converge on a target pressure around atmospheric pressure by drawing of the air by the drive of air pump 13 for the reverse rotation to thereby prevent increase in the leakage of the fuel vapor caused by the high internal pressure of the tank.

Furthermore, when the control proceeds to step S32 immediately after the leak diagnosis, if the pressure is hesitant to quickly reduce and if it is determined that the tank internal pressure is higher than the set value, the control proceeds to step S33 where air pump 13 is driven for reverse rotation so as to accelerate pressure reduction.

Moreover, in addition to the pressure reduction due to the diagnosis, there may be a negative pressure in the tank due to lowering of a fuel level when a vent valve of fuel tank 5 becomes fixed. In this case, by driving air pump 13 for normal rotation, it is possible to rapidly cancel the negative pressure state.

Therefore, an embodiment having a configuration in which air pump 13 is switched between driving for reverse rotation and driving for normal rotation according to the pressure state will be described according to a flow chart in FIG. 8.

Figure 8:
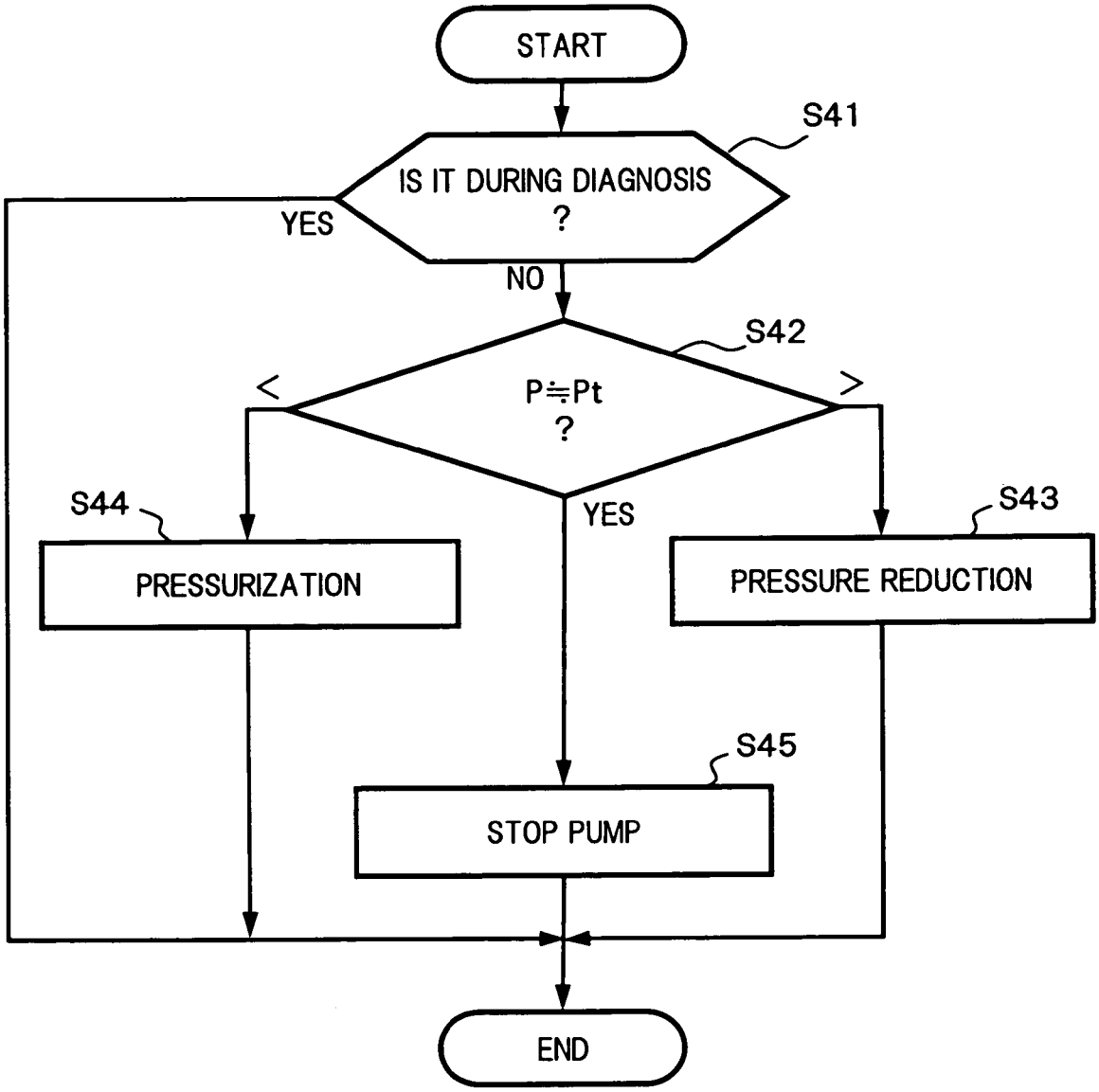
FIG. 8 is a flow chart showing a fifth embodiment of the present invention.

In the flow chart in FIG. 8, at step S41, whether or not it is during the leak diagnosis is determined.

When the leak diagnosis is under execution (YES), the present routine is finished as it is.

When the leak diagnosis is not under execution, on the other hand, the control proceeds to step S42 where determination as to whether or not the pressure P detected by pressure sensor 26 is higher than the target value Pt in the steady state is carried out.

If the actual tank internal pressure P is higher than the target pressure Pt, the control proceeds to step S43 where switching valve 14 is switched to the state in which air pump 13 is connected to fresh air introducing port 9 to drive air pump 13 for reverse rotation to thereby accelerate pressure reduction.

To the contrary, if the actual tank internal pressure P is lower than the target pressure Pt, the control proceeds to step S44 where switching valve 14 is switched to the state in which air pump 13 is connected to fresh air introducing port 9 to drive air pump 13 for normal rotation to thereby promote a quick increase in the pressure.

If the pressure P detected by pressure sensor 26 approaches the target pressure Pt by driving air pump 13 for reverse or normal rotation, the control proceeds from step S42 to step S45 where air pump 13 is stopped and switching valve 14 is switched to the state in which atmospheric opening port 12 is connected to fresh air introducing port 9.

With the above configuration, not only when the tank internal pressure is higher than normal but also when the tank internal pressure is the negative pressure lower than a normal value, such a pressure state can be rapidly cancelled so that the pressure is converged on the pressure around the normal pressure, and it is possible to prevent the tank internal pressure from remaining excessively high or low.

In the embodiments shown in the flow charts of FIGS. 7 and 8, it is possible to prohibit driving of air pump 13 for reverse rotation when the amount of adsorbing of fuel vapor to canister 7 is large.

Figure 9:
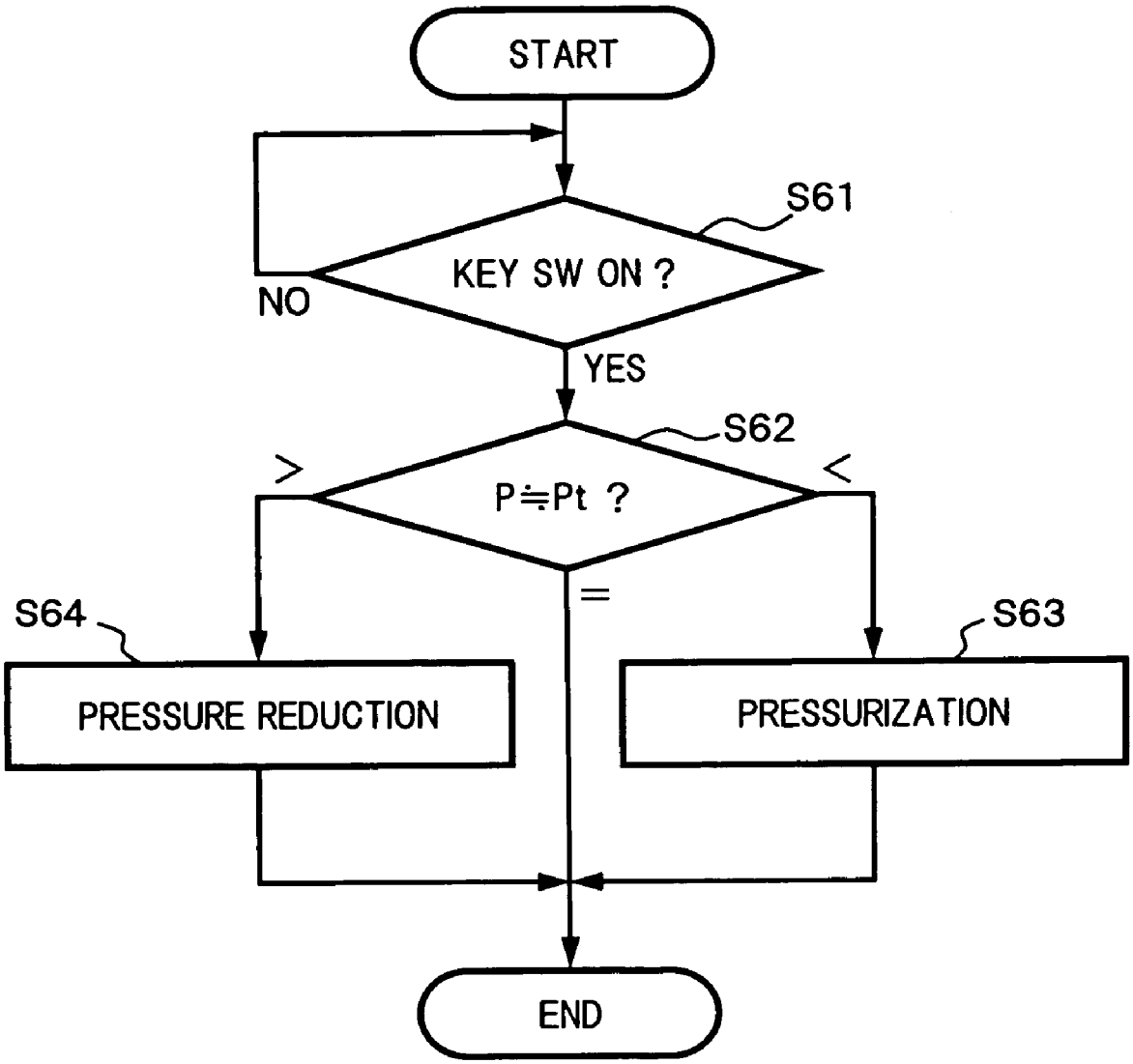
FIG. 9 is a flow chart showing a sixth embodiment of the present invention.

Moreover, it is possible to carry out controlling of driving of air pump 13, which adjustably brings the pressure detected by pressure sensor 26 to a pressure equal to the target pressure in the steady state at the time when key switch 31 is turned on as shown in the flow chart of FIG. 9 to thereby quickly return the tank internal pressure that has been deviated during standstill of engine 1 to the target pressure.

In the flow chart in FIG. 9, whether the key switch is ON or OFF is determined at step S61. When the key switch has been turned on, the control proceeds to step S62.

At step S62, whether or not the pressure P detected by pressure sensor 26 is brought to a pressure equal to the target pressure Pt in the steady state is determined.

Here, when the pressure is lower than the target pressure, the control proceeds to step S63 where air pump 13 is rotated normally to carry out pressurization. When the pressure is higher than the target pressure, the control proceeds to step S64, where air pump 13 is rotated reversely to carry out depressurization.

Figure 10:
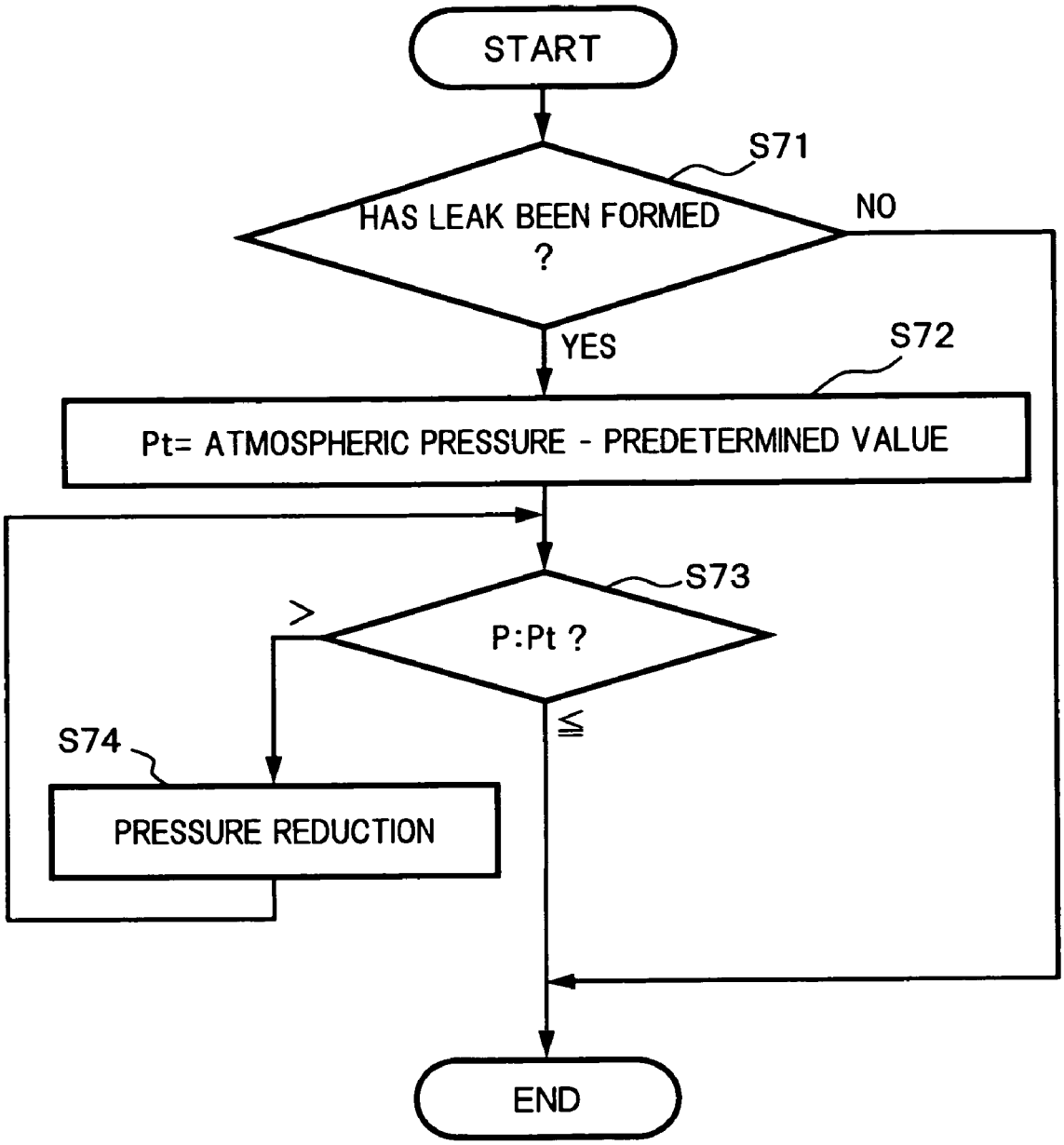
FIG. 10 is a flow chart showing a seventh embodiment of the present invention.

Furthermore, as shown in a flow chart of FIG. 10, if a diagnosis is made indicating an occurrence of the leak as a result of the leak diagnosis by pressurization of the diagnostic space, it is possible to change the target pressure in the steady state to a pressure lower than that when there is no leak. By reducing the pressure toward this target pressure, it is possible to conduct a further delicate leak diagnosis through which the leakage of the fuel vapor through the leak can be reduced.

In the flow chart of FIG. 10, whether or not occurrence of any leak has been detected is determined at step S71.

If the leak has been detected, the control proceeds to step S72 where the target pressure Pt in the steady state is set to the pressure lower than the atmospheric pressure by a predetermined value.

If the occurrence of any leak is not detected, the target pressure Pt in the steady state is set to the atmospheric pressure.

At step S73, an actual pressure P detected by pressure sensor 26 and the target pressure Pt are compared with each other. If the actual pressure P is higher than the target pressure Pt, the control proceeds to step S74 where air pump 13 is reversely rotated to promote pressure reduction.

In the described embodiments, although normal rotation of air pump 13 supplies the air into the diagnostic space to carry out pressurization and reverse rotation draws the air out of the diagnostic space to achieve pressure reduction, it will be obvious to a person having an ordinary skill in the art that normal rotation of the air pump may draw the air to promote pressure reduction.

Furthermore, a pump driven by the engine 1 may alternatively used in place of electric air pump 13.

The entire contents of Japanese Patent Application No. 2005-299125, filed Oct. 13, 2005 and Japanese Patent Application No. 2006-220975, filed Aug. 14, 2006 are incorporated herein by reference.

While only selected embodiments have been chosen to illustrate the present invention, it will be apparent to those skilled in the art from this disclosure that various change and modification can be made herein without departing from the scope of the invention as defined in the appended claims.

Furthermore, the foregoing description of the embodiments according to the present invention is provided for illustration only, and not for the purpose of limiting the invention as defined by the appended claims and their equivalents.

I claim:

1. A fuel supply apparatus for an internal combustion engine, comprising:

a fuel tank;

a pump for changing a pressure that prevails in the fuel tank;

a sensor for detecting the pressure in the fuel tank;

a diagnostic device for detecting a leak in a fuel vapor treatment system including the fuel tank; and a control device for controlling the pump by setting, when a leak has been detected by the diagnostic device, a target pressure in a steady state to a value lower than a case where the leak has not been detected, and by comparing the pressure detected by the sensor and the target pressure in the steady state.

2. A fuel supply apparatus for an internal combustion engine, comprising:

a fuel tank;

an electric pump for changing a pressure that prevails in the fuel tank and capable of varying its rotating direction between a normal direction and a reverse direction in response to switching of a direction in which electric voltage is applied;

a sensor for detecting the pressure in the fuel tank; and a control device for comparing the pressure detected by the sensor and a target pressure in a steady state, and controlling the pump based on the comparison result.

3. The fuel supply apparatus according to claim 2, further comprising a diagnostic device configured to vary the pressure in the fuel tank from a steady-state pressure to thereby detect a leak in a fuel vapor treatment system including the fuel tank, wherein the control device compares the pressure detected by the sensor and the target pressure in the steady state and controls the pump after completion of diagnosis by the diagnostic device.

4. The fuel supply apparatus according to claim 2, wherein when a key switch for the internal combustion engine is turned on, the control device compares the pressure detected by the sensor and the target pressure in the steady state to resultantly control the pump.

5. A fuel supply apparatus for an internal combustion engine, comprising:

a fuel tank;

a pump capable of varying a rotating direction thereof between a normal direction and a reverse direction to thereby switch an inside of the fuel tank between a pressurizing state and a depressurizing state;

a sensor for detecting a pressure in the fuel tank;

a diagnostic device configured to change the pressure in the fuel tank by the pump to thereby detect a leak in a fuel vapor treatment system including the fuel tank, and to diagnose whether the leak is present or absent based on the pressure prevailing in the fuel tank; and a control device for reversing the rotating direction of the pump after the diagnosis by the diagnostic device has been completed to thereby return the pressure in the fuel tank to the target pressure in the steady state.

6. The fuel supply apparatus according to claim 5, wherein the diagnostic device diagnoses whether the leak is present or absent based on the pressure prevailing in the fuel tank when the inside of the fuel tank is pressurized by the pump, and the control device allows the pump to reduce the pressure in the fuel tank to the target pressure in the steady state when occurrence of the leak has been detected by the diagnostic device.

7. The fuel supply apparatus according to claim 6, further comprising a canister that adsorbs the fuel vapor generated in the fuel tank, wherein pressure reduction in the fuel tank by the pump is carried out by drawing air through the canister.

8. The fuel supply apparatus according to claim 7, wherein the control device stops the pressure reduction in the fuel tank by the pump when an amount of adsorbing of fuel vapor to the canister exceeds a predetermined amount.

9. The fuel supply apparatus according to claim 1, wherein the control device sets the target pressure in the steady state to a pressure lower than the atmospheric pressure when occurrence of the leak has been detected.

10. A fuel supply apparatus for an internal combustion engine, comprising:

a fuel tank;

an electric pump for changing a pressure prevailing in the fuel tank and capable of varying its rotating direction between a normal direction and a reverse direction in response to switching of a direction in which electric voltage is applied;

pressure detecting means for detecting the pressure in the fuel tank; and controlling means for controlling the electric pump based on comparison between the pressure detected by the pressure detecting means and a target pressure in a steady state.

11. A method of controlling a pressure prevailing in a fuel supply apparatus of an internal combustion engine, the fuel supply apparatus including a fuel tank and a pump capable of changing the pressure prevailing in the fuel tank, wherein the method comprises the steps of:

detecting the pressure in the fuel tank;

setting a target value of the pressure in the fuel tank in a steady state;

changing the pressure in the fuel tank by the pump to thereby detect a leak in a fuel vapor treatment system including the fuel tank, and diagnosing whether the leak is present or absent based on the pressure prevailing in the fuel tank;

varying, when the leak has been detected, the target pressure in the steady state to a pressure value lower than in a case where the leak has not been; and controlling the pump based on a detected value of the pressure and the target value.

12. A method of controlling a pressure prevailing in a fuel supply apparatus of an internal combustion engine, the fuel supply apparatus including a fuel tank and a pump capable of changing the pressure prevailing in the fuel tank, wherein the method comprises the steps of:

detecting the pressure in the fuel tank;

setting a target value of the pressure in the fuel tank in a steady state;

calculating a deviation of the detected value of the pressure and the target value from each other; and switching a rotating direction of the pump between a normal direction and a reverse direction according to the deviation.

13. A method of controlling a pressure prevailing in a fuel supply apparatus of an internal combustion engine, the fuel supply apparatus including a fuel tank and a pump capable of changing the pressure prevailing in the fuel tank, wherein the method comprises the steps of:

changing the pressure in the fuel tank by the pump to thereby detect a leak in a fuel vapor treatment system including the fuel tank;

detecting the pressure in the fuel tank;

setting a target value of the pressure in the fuel tank in a steady state;

determining the end of the leak detection; and controlling the pump based on the detected value of the pressure and the target value after completion of detection of the leak.

14. The method according to claim 12, further comprising the step of:

changing the pressure in the fuel tank from a steady-state pressure to thereby detect a leak in a fuel vapor treatment system including the fuel tank, wherein the step of controlling the pump includes the steps of:

determining the end of the leak detection; and controlling the pump based on the detected value of the pressure and the target value after completion of detection of the leak in the fuel vapor treatment system.

15. The method according to claim 12, wherein the step of controlling the pump includes steps of:

determining whether a key switch is ON or OFF; and controlling the pump based on the detected value of the pressure and the target value when the key switch has been turned on.

16. The method according to claim 13, wherein the step of detecting the leak comprises the step of:

pressurizing an inside of the fuel tank by the pump, and the step of controlling the pump comprises the step of:

reducing the pressure prevailing in the fuel tank to the target value in the steady state by the pump when occurrence of the leak has been detected by the diagnostic device.

17. The method according to claim 16, wherein the step of controlling the pump carries out drawing of air by the pump through a canister capable of adsorbing fuel vapor generated in the fuel tank when reducing the pressure in the fuel tank.

18. The method according to claim 17, further comprising the step of:

prohibiting pressure reduction in the fuel tank by the pump when an amount of adsorbing of fuel vapor to the canister exceeds a predetermined amount.

19. The method according to claim 11, wherein the step of changing the target pressure sets the target pressure in the steady state to a pressure lower than the atmospheric pressure when occurrence of the leak has been detected.

* * * * *